US010080415B2

(12) United States Patent
Silvers

(10) Patent No.: US 10,080,415 B2
(45) **Date of Patent: *Sep. 25, 2018**

(54) LIP BALM STRIP

(76) Inventor: Forrest R Silvers, New York, NY (US)

( * ) Notice: Subject to any disclaimer, the term of this patent is extended or adjusted under 35 U.S.C. 154(b) by 360 days.

This patent is subject to a terminal disclaimer.

(21) Appl. No.: 13/084,338

(22) Filed: Apr. 11, 2011

(65) Prior Publication Data

US 2012/0257919 A1 Oct. 11, 2012

(51) Int. Cl.
*A45D 40/00* (2006.01)
*A45D 40/26* (2006.01)

(52) U.S. Cl.
CPC ..... *A45D 40/0087* (2013.01); *A45D 40/26* (2013.01); *A45D 2040/0012* (2013.01); *A45D 2200/1009* (2013.01)

(58) Field of Classification Search
CPC ..... A45D 40/30; A45D 40/0087; A45D 2200/1027
USPC ..... 132/320
See application file for complete search history.

(56) References Cited

U.S. PATENT DOCUMENTS 2,509,631 A * 5/1950 Dyer ..... 132/333
2,735,435 A * 2/1956 Feinstein ..... 132/320
3,298,507 A * 1/1967 Micciche ..... 206/361
3,308,837 A * 3/1967 Selleck ..... 15/104.94
3,952,867 A * 4/1976 McCord ..... 206/229
4,611,611 A * 9/1986 Beal, Jr. ..... A45D 40/0087 132/320
4,995,408 A * 2/1991 Wallschlaeger ..... 132/320
5,020,553 A * 6/1991 De La Rocha ..... 132/320
6,007,264 A * 12/1999 Koptis ..... 401/132
6,619,298 B2 * 9/2003 Gueret ..... 132/320
7,506,762 B2 * 3/2009 Nelson et al. ..... 206/484.1
8,333,205 B2 * 12/2012 Haddad ..... 132/200
2006/0021632 A1 * 2/2006 Dobler ..... A45D 40/0087 132/320
2008/0019758 A1 * 1/2008 Mallardi, III ..... 401/6
2008/0083423 A1 * 4/2008 Dobler et al. ..... 132/320
2009/0241982 A1 * 10/2009 Van Alphen ..... A45D 40/0087 132/320
2011/0073125 A1 * 3/2011 Iosilevich ..... 132/200

* cited by examiner

*Primary Examiner* — David Walczak
*Assistant Examiner* — Joshua Wiljanen

(57) ABSTRACT

Lip balm strip is a sheet of material that conveniently dispenses lip balm. A section of the lip balm strip is not covered in lip balm which provides a clean surface for the user to hold on to. The balm covered side of the strip is placed in the mouth. The user then presses their lips down and slides the strip through their lips to apply the lip balm. There is a smooth edge on this side of the strip provided to prevent injury to the mouth. The lip balm strip is individually wrapped to preserve the strip for re-use and is disposable. Other variations and features are described.

10 Claims, 5 Drawing Sheets

LIP BALM STRIP

BACKGROUND OF THE INVENTION

Lip balm is well known. The following U.S. patents identify various types of dispensers and applicators for lip balm and lipstick: U.S. Pat. Nos. 5,842,802; 6,939,070; 7,506,762; 6,007,264; 4,995,408; 8,333,205; 6,619,298; 5,020,553; 4,611,611.

Known dispensers and applicators for lip balm, including those described in the above-identified patents, however, suffer from one or more of the following shortcomings.

Various dispensers and applicators hold up to a several month supply of lip balm in a single dispenser. If such a dispenser or applicator is lost or misplaced, a large amount of lip balm is lost and, thus, must be replaced. This is expensive for the consumer and potentially harmful to the environment.

Various dispensers and applicators have caps that, if lost or misplaced, results in the drying out of a several month supply of lip balm and, thus, must be replaced. This is expensive for the consumer and potentially harmful to the environment.

Various dispensers and applicators are unsuitable for sharing due to the risk of spreading germs and viruses. It generally is unsanitary for multiple people to apply lip balm from the same container onto their lips or fingers.

Various dispensers and applicators are potentially unsanitary for repeated use by a person who is sick, due to the likelihood that a person will re-infect himself with repeated usage of the dispenser.

Various dispensers and applicators are difficult or inconvenient to carry due to their large or awkward shape or size and weight.

Various dispensers and applicators are aesthetically undesirable for men due to their resemblance to a female cosmetic, such as a lipstick applicator. Hence, many men avoid such products.

Various dispensers and applicators have a lip imprint, typically in the female shape and size and require putting the users lips in that exact imprint location.

Various dispensers and applicators require compressing the lips and pulling the applicator out in front with a forward motion in order to deposit the cosmetic material.

Various dispensers and applicators are not one size fits all, and are not designed for both genders Various dispensers and applicators are a single dispensing package where the contents oozes out and then needs to be further applied, making it more difficult and messy to apply to the visible area such as the lips.

Various dispensers and applicators are housed in a single dispenser thus making it impossible for a person to physically divide and spread out the lip balm supply.

Various dispensers and applicators require consumers to purchase, at a single instance, a several month supply of lip balm that has the same flavor and texture. Hence, if a consumer is unhappy with the flavor and/or texture of the lip balm, the product must either be replaced in its entirety or the consumer undesirably is forced to use an unsatisfactory product.

In light of the foregoing, there is a need for a lip balm applicator that does not suffer from the aforementioned undesirable features and problems.

OBJECTS AND SUMMARY OF THE INVENTION

It is therefore an object of the present invention to provide a lip balm applicator and a method of use thereof that does not suffer from any of the aforementioned problems with the prior art.

Accordingly, the lip balm applicator of the present invention provides the consumer with a new option; the first ever light-weight, reusable, disposable lip balm dispenser. As described in greater detail below, the lip balm applicator of the present invention is a lip balm applicator strip (also referred to herein as "lip balm strip") that entails the below discussed features and advantages.

The lip balm applicator is provided as a set of lip balm strips, which may be sold in packs, and which are individually wrapped and with each strip containing enough lip balm for a relatively small number of uses. Hence, if a lip balm strip is lost or misplaced, the consumer only loses a small amount of lip balm and the entire supply provided in the pack is not lost. Thus, the consumer saves money. The result also is environmentally friendly.

A new individual lip balm strip, individually packaged, within the set can easily be given to another person, thus preventing the spread of germs that otherwise would result from a single applicator being used by multiple persons.

Each lip balm strip is very easy to transport; it is flat and thin, so it conveniently fits into a consumer's pocket.

By having multiple lip balm strips within a package, the strips can be placed or left at different locations, as needed or desired. Hence, the present invention enables a consumer to divide his/her supply of lip balm amongst various locations, thus making the lip balm strips convenient and cost effective.

Due to the shape and size of an individual lip balm strip, it is gender neutral and, thus, the present invention is appealing to male consumers.

The lip balm strip of the present invention does not utilize a plastic or metal tube or container, and thus is environmentally friendly due to the relatively small amount of packaging that is employed, and thus is more easily recyclable.

Each lip balm strip contains a relatively small amount of lip balm, and a package containing multiple lip balm strips may include strips of a variety of flavors and/or textures. Thus, a consumer has to commit to only a specific flavor and/or texture for a relatively small amount of lip balm. If a particular flavor and/or texture is undesirable to a particular consumer, then only a very small amount of lip balm is wasted. That is, only the one or two strips containing such undesired flavor and/or texture will be wasted. The other strips in the package, having a different flavor and/or texture, will not be wasted.

As set forth in greater detail below, the lip balm strip of the present invention is summarized by a strip of material having a top surface and a bottom surface, the strip being divided between a first section and a second section, and lip balm is disposed on the top and/or bottom surface of the first section of the strip of material. As a feature, the top and/or bottom surface of the second section does not have lip balm disposed thereon. As another feature, the lip balm is disposed on both the top and bottom surfaces of the first section. As a further feature, the strip is folded material, such as a folded piece of paper. As yet another feature, the strip is substantially rectangular in shape and includes rounded edges.

In addition, the invention entails a system comprising a lip balm dispensing apparatus (i.e., the lip balm strip) and a storage package for containing and storing the lip balm dispensing apparatus. As a feature, the storage package includes a pull-tab for opening so as to gain access to the stored lip balm dispensing apparatus. Rather than a pull-tab, other types of opening mechanisms including a tear string or adhesive tab may be employed. As another feature, a second lip balm dispensing apparatus is stored within a second storage package (i.e., two lip balm strips each within their own respective storage package) and the system further includes a storage container for storing both storage packages, each having therein a respective lip balm dispensing apparatus. The storage container can be in various forms, including a large bin or other container that is able to hold multiple storage packages.

Moreover, as also discussed in detail below, the invention entails a method of applying lip balm to the lips of a person, by providing a lip balm strip having the features as discussed herein (any version thereof), placing a portion of the lip balm strip between the lips of the person, with the lips of the person being in contact with the lip balm strip, and moving the lip balm strip sideways relative to the mouth of the person so that portions of the lip balm disposed on the lip balm strip are applied to portions of the lips of the person.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

As used herein, the term "lip balm" is a substance that may be applied topically to the lips of a mouth to relieve chapped or dry lips, treat angular cheilitis, stomatitis, and cold sores, or be used for another purpose, such as protecting against or treating sun burn or wind burn, treating medical maladies, or other purposes, or for coloring the lips, or for providing the lips with a glossy or semi-glossy appearance, and/or any combination thereof. The lip balm may be a wax-like substance, typical of currently available lip balms, but may be made of other types of substances that are desired to be applied to a person's lips, including but not limited to lip-stick, as well as flavored items.

The lip balm strip of the present invention is a revolutionary new way to dispense lip balm. Existing lip balm dispensers are wasteful, difficult to transport, and unhygienic to the user or users if shared. The lip balm strip of the invention is an easy, efficient, sanitary and environmentally friendly way to use, carry, and share lip balm.

Figure 1:
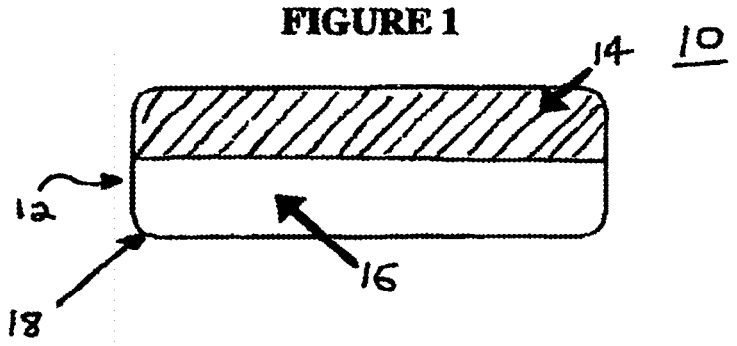
FIG. 1 is a schematic illustration of a top view of the lip balm strip of the present invention.
Figure 2:
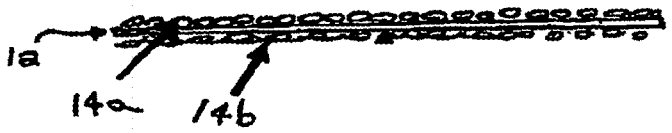
FIG. 2 is a schematic illustration of a front view of the lip balm strip of the present invention.
Figure 3:
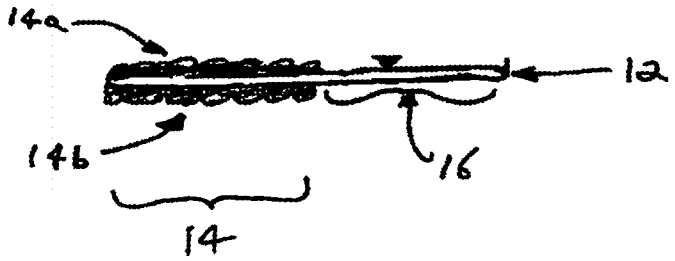
FIG. 3 is another schematic illustration of the lip balm strip of the present invention.

As shown in the figures, the "lip balm strip" of the invention is a single sheet of material that conveniently dispenses lip balm. FIGS. 1, 2 and 3 show various views of the lip balm strip of the invention. In particular, FIG. 1 is a top view, FIG. 2 is a front view, and FIG. 3 is a side view.

As shown in FIGS. 1-3, lip balm strip 10 of the present invention is comprised of a strip of paper or other material, such as plastic or other suitable substance. For convenience herein, the strip of material shown in the figures is referred to herein as paper 12. As shown, paper 12 is divided into two sections: a first section 14 on which lip balm is disposed and a second section 16 that does not contain lip balm. Although FIG. 1 shows paper 12 divided substantially equally to provide the two sections 14 and 16, the paper may be divided to provide unequal sections (e.g., section 14 represents 40% of the surface area of the paper, with section 16 representing 60% of the paper).

The paper 12 has a top and bottom, and accordingly both of the first section 14 and second section 16 have respective tops and bottoms. As shown in FIG. 2, lip balm is disposed on both the top and bottom of the first section 14. That is, lip balm 14*a* is disposed on the top of the first section 14, and lip balm 14*b* is disposed on the bottom of the first section. No lip balm is disposed on either the top or bottom portions of the second section 16. Moreover, paper 12 has rounded corners 18, as shown in FIG. 1. In a variation of that shown in FIG. 1, paper 12 may include non-rounded corners, or may include only 1, 2 or 3 rounded corners.

In accordance with the present invention, paper 12 is suited for being placed within a user's mouth, in which section 16 is provided to enable the user to hold onto the lip balm strip 10 of the present invention without getting lip balm onto his/her fingers. The rounded corners 18 of paper 12 beneficially prevent cuts (e.g., paper cuts) or other injury on the user's fingers, lips, tongues or other mouth or face portion.

As also shown in FIG. 3, first section 14 includes lip balm 14*a*, 14*b* on both the top and bottom, whereas second section 16 does not include any lip balm.

It is appreciated that FIGS. 1-3 show a first embodiment of the lip balm strip of the present invention. The present invention includes other embodiments and/or variations of that shown in FIGS. 1-3. The lip balm strip may have a shape different from the rectangular shape shown in FIG. 1. For example, the strip may be curved or have a different geometric or non-geometric shape. Moreover, in another version, lip balm is disposed only on the top surface (or only on the bottom surface) of section 14. In a further version, lip balm is disposed on one of the surfaces of section 16. For example, lip balm may be disposed on a top surface of section 16, along with providing lip balm on the top and/or bottom surfaces of section 14. In yet another version, a lip-balm free section is provided along the perimeter of the entire paper 12. Yet other versions are discussed below.

Figure 4A:
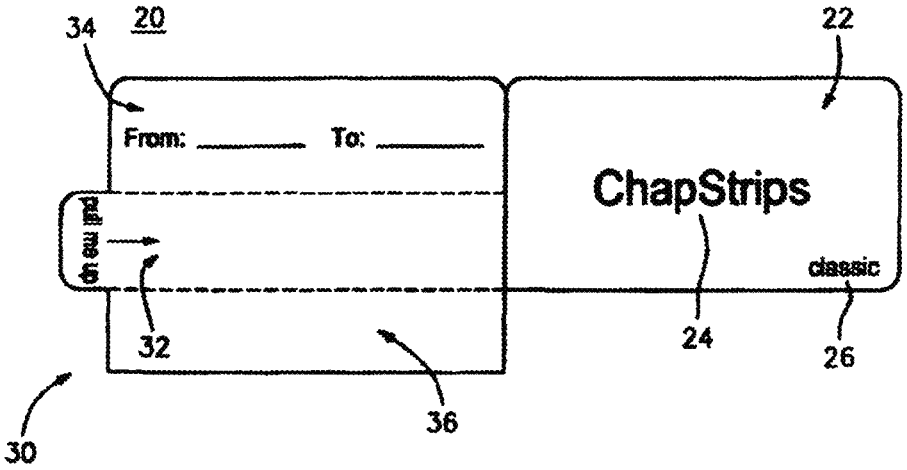
FIGS. 4A, 4B and 4C are schematic illustrations of an exemplary packaging for the lip balm strip of the present invention.
Figure 4B:
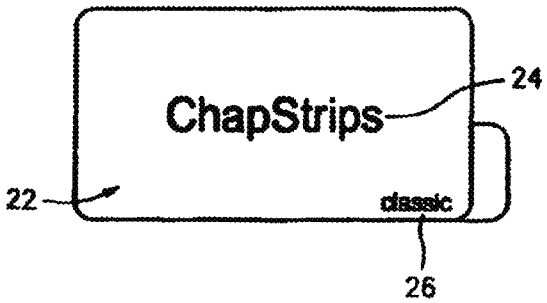
Figure 4C:
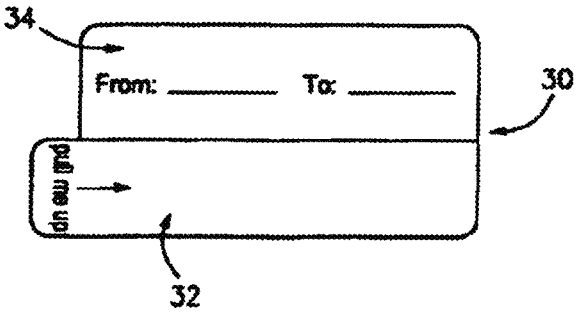

FIGS. 4A, 4B and 4C show different views of an exemplary package 20 (also called "storage package" herein) for a single lip balm strip, in accordance with the present invention. FIG. 4A shows the package 20 in an unassembled state. FIG. 4B shows the front of the package 20. FIG. 4C shows the back of the package 20.

As shown in FIGS. 4A and 4B, package 20 includes a front side 22 in which a brand name (e.g., 24) and other identifying marks (e.g., 26) may be provided. As shown in FIGS. 4A and 4C, package 20 includes a back 30 that contains a pull-tab 32 specific for the shape of the strip for opening and a back side area 34 to display other text and/or graphical information. Further, FIG. 1 shows an inside fold portion 36 that is used to seal the package 20 during construction thereof and is generally hidden in the completed package.

In accordance with the present invention, a single lip balm strip 10 is fully sealed within package 20 during manufacture. Hence, a single package 20 contains a single lip balm strip 10. During use, as discussed below, a consumer tears pull-tab 32 to open package 20 to gain access to the stored lip balm strip 10. After use, the lip balm strip 10 may be placed back in package 20 for storage until the lip balm strip is needed again. As discussed further below, only a portion of the lip balm disposed on the strip may be used during a single application by a user, in which case, the user may store the strip back in package 20 for later usage. Thus, the strip may be stored in package 20 until the lip balm on the strip is completely depleted.

In the exemplary package 20 shown in FIGS. 4A-4C, the package 20 is not fully resealable, but the package still may be used for subsequent storage of a used lip balm strip. In another version of a package that stores a lip balm strip, the package is resealable. In such version, such resealing may be accomplished by adhesive or other known technique.

Figure 5:
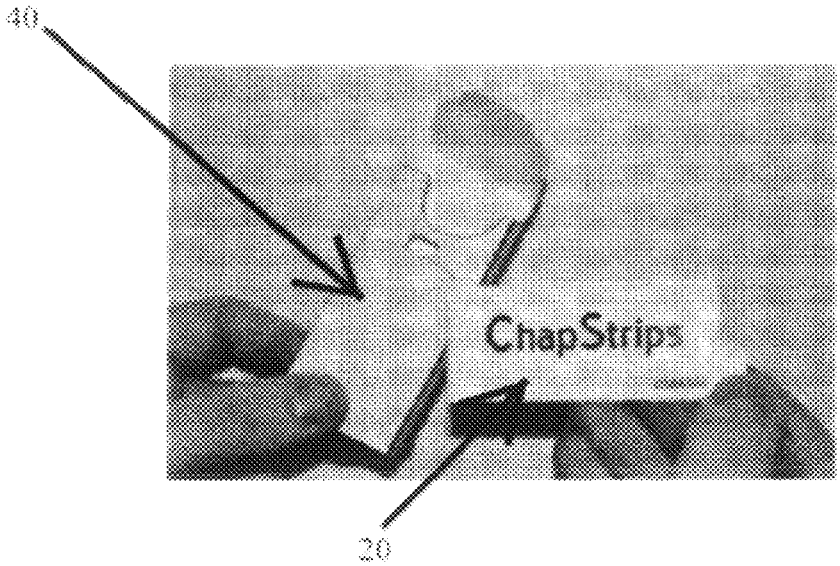
FIG. 5 shows a storage box along with an individual package containing a lip balm strip in accordance with the present invention.

For any of the versions of the lip balm strip and package thereof as described herein, multiple packages (each containing a respective lip balm strip) are further stored in a storage container 40, as shown in FIG. 5. That is, storage container 40 holds multiple packages (e.g., package 20), wherein each package contains a respective lip balm strip. Preferably, storage container 40 is resealable.

Figure 6:
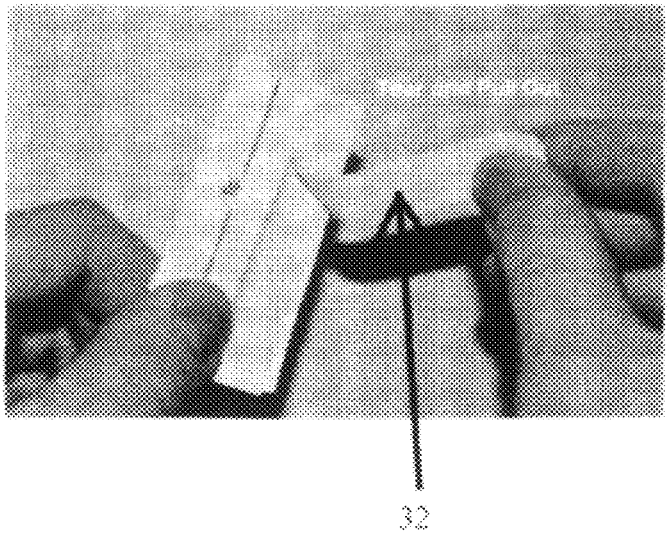
FIG. 6 shows the tearing of a tab on the lip balm strip package to gain access to the lip balm strip in accordance with the present invention.
Figure 7:
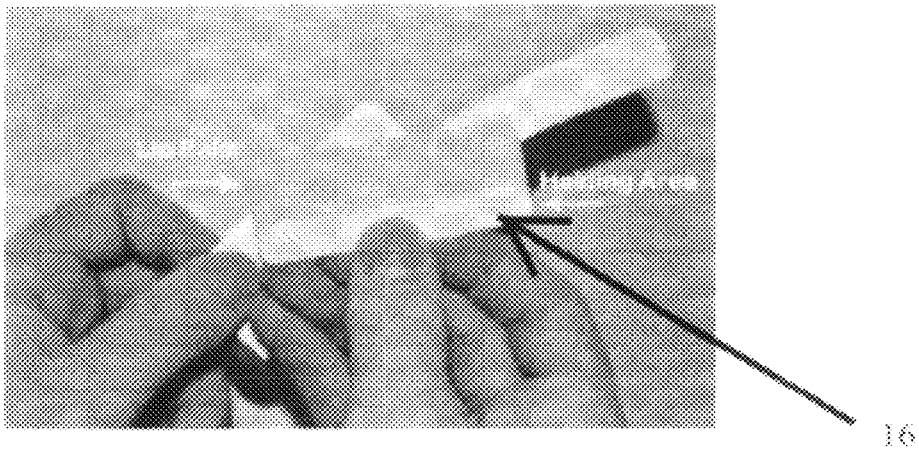
FIG. 7 shows the lip balm strip removed from the package with a person holding a portion of the lip balm strip that does not contain lip balm in accordance with the present invention.

Referring to FIGS. 5-8 of the drawings of the present invention, the method of using the various components described herein are illustrated. Initially, as shown in FIG. 5, a package 20 containing a lip balm strip is removed from storage container 40. Then, the pull-tab 32 on the package is torn (or otherwise peeled or ripped, as appropriate) as shown in FIG. 6. After being fully torn, the package is opened to gain access to the lip balm strip. The lip balm strip is removed from the package. Preferably, the portion of the lip balm strip that is initially accessible (i.e., picked up by a user's fingers) is that portion that does not contain lip balm (e.g., second section 16 shown in FIG. 1). In such case, a user can remove the lip balm strip without getting lip balm on his/her fingers. FIG. 7 shows the removed lip balm strip, whereupon the user is holding section 16 of the lip balm strip that does not contain lip balm.

As discussed herein, the strip is equipped with four rounded edges to prevent cuts. In one version of the present invention, the strip is folded paper thus resulting in a front edge (i.e., the edge that goes into a user's mouth) that does not contain a sharp portion. The folded paper is maintained in the folded state by means of appropriate adhesive that contains the two portions of the paper connected. In another version, there is no adhesive between the folded portions of the paper. In yet a further version, the material is not folded and preferably is sufficiently thick and smooth so as to not irritate, cut, cause discomfort or provide any other undesirable effect on the user.

Figure 8:
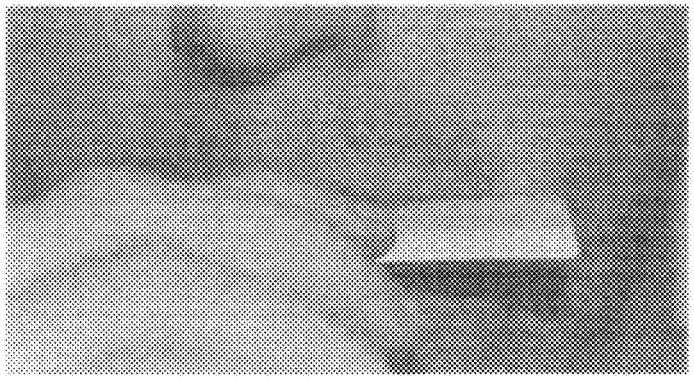
FIG. 8 shows the application of lip balm to a person's lips using the lip balm strip in accordance with the present invention.

In the various versions of the lip balm strip described herein, to apply the lip balm to one's lips, the side of the strip that contains lip balm is placed into a user's mouth, as shown in FIG. 8. Generally, the first section 14 (see FIGS. 1, 3) of the strip that contains lip balm (14*a*, 14*b* in FIG. 3) is placed within the user's mouth and appropriately positioned between the user's upper and lower lips. Preferably, the strip is initially positioned on one side of the lips (e.g., the left or right side of the lips/mouth). The second section that does not contain lip balm generally remains outside the mouth and remains held by the user's fingers.

Then, with the user's lips contacting the upper and lower surfaces of the strip, the strip is moved sideways relative to the mouth thus causing lip balm disposed on the strip to be transferred to the user's lips. Generally, if the strip is moved from one end of the mouth to the other end, a substantial portion of the user's lips will be applied with lip balm. During application, the user may move his/her lips, as needed, to facilitate spreading of the lip balm to all desired areas of the lips.

As mentioned above, since the strip contains a fold in one version, the product has a smooth surface that enters the mouth in order to prevent or minimize cuts. Also, since the strip contains lip balm on top and bottom surfaces, in certain versions, lip balm is applied at the same time to both the top and bottom lips. However, in other versions, as herein mentioned, the lip balm strip contains lip balm on only a single surface.

Also as discussed herein, the lip balm strip is moved sideways along the mouth from left to right, or from right to left, while the user's lips are pressed together, in order to effectively apply the lip balm from the strip to the lips. With such single movement, the balm is properly applied to the lips without any further action. For example, there is no need for the user to pucker his/her lips. In fact, the user does not pucker the lips during application of the lip balm as herein described. Nor does the user need to place lips over an exact location. Moreover, during application, the user conveniently holds the strip generally around the mid-section portion at the edge that does not contain lip balm, as shown in FIGS. 7 and 8.

Having applied lip balm in the manner described herein, the user's lips are moisturized. The lip balm strip can be stored back within the package 20 (e.g., FIGS. 4A, 5) for further use at a later time. If all of the lip balm has been used from a strip, the strip can be discarded and another strip can be removed from another package 20.

In accordance with the present invention, the lip balm strip is pre-folded in certain versions and preferably the folded strip is sealed with an adhesive to prevent unfolding. As discussed above, the fold creates a smooth edge along one edge of the strip (i.e., the edge that goes into the user's mouth), thus allowing the user to slide the strip between the lips without fear of cutting a lip or tongue. Further, as mentioned above, the strip in a different version is not folded. Moreover, lip balm covers the top and bottom surfaces of the strip so that both the upper and lower lips are applied with lip balm during use. The strip contains a section that does not contain lip balm so that the strip can be held without getting lip balm on the user's fingers. Further, all four corners of the lip balm strip are rounded thus further preventing cuts during usage.

The lip balm strip has a thickness of preferably between 0.1 and 1.0 millimeters, a length of preferably between 4 and 10 centimeters, and a width preferably of between 1 and 6 centimeters. However, strips with other dimensions also may be utilized, if desired. The strip may be made of paperboard or other suitable material that contains a coating that prevents absorption of the balm or any moisture encountered during use. Materials that inherently do not absorb moisture and that are not materially affected by the balm also may be utilized.

An exemplary composition of the lip balm is identified in Table 1 below.

TABLE 1

| Base | Weight (g) |
|---|---|
| Almond Oil: | 5.0711 |
| Coconut Oil: | 3.2708 |
| Cocoa Butter: | 7.2088 |
| Lanolin: | 3.0614 |
| Bees Wax: | 2.0946 |
| Total Mass: | 20.7067 |

The packaging of an individual lip balm strip may be made of any suitable material, such as a paper product, such packaging preferably containing a glossy finish. In another version, the packaging of an individual lip balm strip is a thin wrapper-type package made of aluminum foil, cellophane or other suitable wrapper. In such case, the wrapper serves to prevent the lip balm of each strip from spreading around a package that contains multiple strips. In yet a further version, an individual lip balm strip is wrapped within the above-mentioned thin wrapper-type package, which is contained within a lip balm strip package (e.g., such as shown in FIG. 6). Other suitable types of packaging may also be employed.

Having described the present invention in the context of the illustrative figures, there are a number of additional variations of the lip balm strip of the present invention.

The lip balm could be provided on only a single surface (i.e., top or bottom) of a strip. The lip balm also could be distributed on the entire surface (i.e., top or bottom) or both the entire top and bottom surfaces.

The lip balm strip may be provided without an adhesive. During use, the user first folds the strip and then applies the lip balm in the manner described herein.

In another variation, a folded strip contains lip balm on its inner surfaces, wherein the user unfolds the strip and then folds it so that the lip balm is disposed on the outer surfaces, and then the strip is used in the manner described herein. In this version, no lip balm initially is provided on the outer surfaces of the strip so that the strip can be removed from its packaging without the user accidentally contacting a portion that contains lip balm.

In the version described in the immediately preceding paragraph, such version can yet be modified to provide a combined lip balm strip/storage package. The combined lip balm strip/storage package of the present invention is described with reference to FIGS. 9, 10A, 10B and 11.

Figure 9:
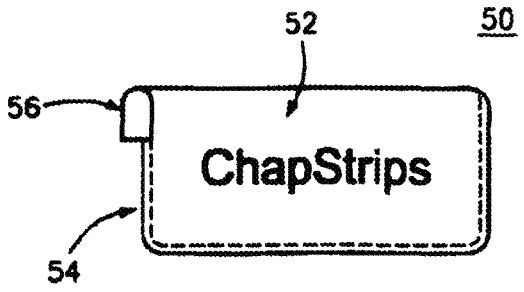
FIG. 9 is a schematic illustration of the combined lip balm strip/storage package of the present invention.
Figure 10A:
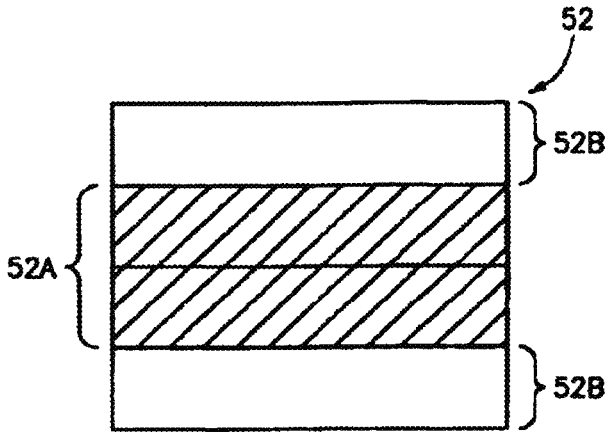
FIGS. 10A and 10B are schematic illustrations of an opened combined lip balm strip/storage package and a removed tab, respectively, in accordance with the present invention.
Figure 10B:
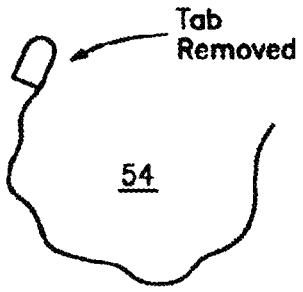

FIG. 9 is a schematic illustration of the combined lip balm strip/storage package 50. The combined lip balm strip/storage package 50 includes a folded piece of material 52 along with a removable tab 54. The tab 54 optionally may include a portion 56 designed for easy grabbing/holding by one's fingers. To remove the tab, a slight force is exerted on the tab. After the tab is removed folded piece of material 52 is unfolded, such as shown in FIG. 10A. FIG. 10B shows the removed tab.

Figure 11:
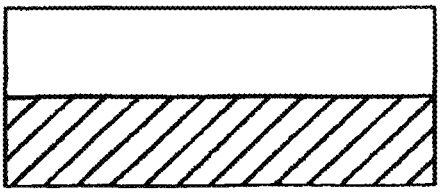
FIG. 11 is a schematic illustration of the combined lip balm strip/storage package ready for use.

As shown in FIG. 10A, material 52 contains a first section 52A that contains lip balm and a second section 52B (comprised of 2 parts) that does not contain lip balm. Thereafter, material 52 is folded in half in a manner that keeps the lip balm on the outer surfaces to provide the folded strip that is shown in FIG. 11. The folded strip then may be used to apply lip balm to a person's lips in the manner described herein. Notably, the strip in the version shown in FIGS. 9, 10A and 11 does not contain any adhesive nor does it require a separate storage package. Accordingly, the storage container 40 shown in FIG. 5 may contain multiple combined lip balm strip/storage packages shown in FIG. 9.

The composition of the lip balm itself may be different from the exemplary composition identified above. Any suitable composition of lip balm may be utilized with the present invention.

The storage container containing multiple packages with lip balm strips therein may include strips of a variety of flavors and/or textures and/or colors. A container may contain one or more packages with each containing multiple lip balm strips of a single (or multiple) flavor, texture, color, etc.

The lip balm may be applied by a forward motion or other direction through the mouth, rather than by the above-described sideways motion.

The present invention has been described in the context of a number of embodiments, and multiple variations and examples thereof. It is to be understood, however, that other expedients known to those skilled in the art or disclosed herein may be employed without departing from the spirit of the invention.

Therefore, it is intended that the appended claims be interpreted as including the embodiments described herein, the alternatives mentioned above, and all equivalents thereto.

What is claimed is:

1. Apparatus for dispensing lip balm, comprising:

a strip of material having a top surface and a bottom surface, the strip divided between a first section and a second section; and lip balm disposed on at least one of a top and bottom surface of the first section of the strip of material; further comprising lip balm disposed on one of said top and bottom surfaces of the second section so that an entire surface of the strip of material has lip balm disposed thereon; wherein the apparatus is a strip of folded, not in half, material that is within a temporarily sealed storage container; with a method of applying the lip balm by pressing the lips down along the longitudinal axis and sliding the strip across the lips.

2. A system comprising: the lip balm dispensing apparatus as recited in claim 1; and a storage package for containing and storing the lip balm dispensing apparatus, wherein the apparatus is a storage package in which the strip of material is folded not in half and temporarily sealed along an outer edge of the folded strip of material, the lip balm being disposed on an inner portion of the folded strip of material and is accessible upon disconnecting the edge and unfolding the folded strip of material.

3. A method of applying lip balm to lips of a person, comprising the steps of:

providing a lip balm strip, the lip balm strip including a strip of material having a top surface and a bottom surface, the strip of material being divided between a first section and a second section, and lip balm being disposed on at least one of a top and bottom surface of the first section of the strip of material;

placing a portion of the lip balm strip between the lips of the person, the lips of the person being in contact with the lip balm strip; and moving the lip balm strip sideways relative to a mouth of the person so that portions of the lip balm disposed on the lip balm strip are applied to portions of the lips of the person.

4. The method of claim 3 wherein providing the lip balm strip comprises providing a lip balm strip that contains lip balm on both the top and bottom surfaces of the first section.

5. The method of claim 3 comprising holding with fingers the second section of the lip balm strip so that the fingers do not touch the lip balm disposed on the first section, wherein the step of moving is carried out while the fingers hold the second section of the lip balm strip so that lip balm is applied to the lips without the fingers holding the lip balm strip from contacting the lip balm.

6. The method of claim 3 wherein the provided lip balm strip is its own storage package in which the strip of material is folded not in half, the lip balm being disposed on an inner portion of the folded strip of material, the method further comprising the steps of:

unfolding the folded strip of material to reveal the lip balm.

7. The method of claim 3 wherein the provided lip balm strip of material is non folded and is in a storage package that is temporary sealed, and is accessible by removing the seal and gaining access to the uncoated lip balm area.

8. The method of claim 3 wherein the provided lip balm strip is a storage package in which the strip of material is folded not in half and temporarily sealed along an outer edge of the folded strip of material, the lip balm being disposed on an inner portion of the folded strip of material, the method further comprising the steps of:

unsealing the sealed edge of the folded strip of material;

unfolding the folded strip of material to reveal the lip balm.

9. The method of claim 3, wherein the provided lip balm strip is its own storage package in which the strip of material is folded, not in half, the lip balm being disposed on an inner portion of the folded strip of material with or without adhesive and held together by the user, the method further comprising the step of:

unfolding the folded not in half strip of material to reveal the lip balm.

10. The method of claim 3, wherein the provided lip balm strip is a non-folded strip of material and the method further comprising the step of folding the non-folded strip of material to provide the lip balm on both upper and lower surfaces of the material.

* * * * *